US006532995B1

(12) United States Patent
Asahi et al.

(10) Patent No.: US 6,532,995 B1
(45) Date of Patent: Mar. 18, 2003

(54) SUPER-HIGH-STRENGTH LINE PIPE EXCELLENT IN LOW TEMPERATURE TOUGHNESS AND PRODUCTION METHOD THEREOF

(75) Inventors: Hitoshi Asahi, Futtsu (JP); Hiroshi Tamehiro, Futtsu (JP); Takuya Hara, Futtsu (JP); Yoshio Terada, Kimitsu (JP); Shigeru Ohkita, Futtsu (JP); Kunio Koyama, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/478,653

(22) Filed: Jan. 6, 2000

(30) Foreign Application Priority Data

Jan. 7, 1999 (JP) ..... 11-002042

(51) Int. Cl.[7] ..... F16L 9/00

(52) U.S. Cl. ..... 138/171; 138/170; 138/142; 29/6.1

(58) Field of Search ..... 138/170, 171, 138/142; 29/6, 1

(56) References Cited

U.S. PATENT DOCUMENTS

| | | | | | |
|---|---|---|---|---|---|
| 1,665,851 | A | * | 4/1928 | Harris | 138/171 |
| 4,558,721 | A | * | 12/1985 | Trudell et al. | 138/171 |
| 4,804,021 | A | * | 2/1989 | Hasegawa et al. | 138/171 |
| 5,181,974 | A | * | 1/1993 | Tanabe et al. | 138/171 |
| 5,275,893 | A | * | 1/1994 | Miyasaka et al. | 138/142 |
| 5,397,654 | A | * | 3/1995 | Endo et al. | 138/171 |
| 6,114,656 | A | * | 9/2000 | Fairchild | 219/137 WM |
| 6,129,999 | A | * | 10/2000 | Ueda et al. | 138/142 |
| 6,188,037 | B1 | * | 2/2001 | Hamada et al. | 219/61 |
| 6,224,689 | B1 | * | 5/2001 | Koo et al. | 148/320 |
| 6,264,760 | B1 | * | 7/2001 | Tamehiro et al. | 148/336 |

FOREIGN PATENT DOCUMENTS

| | | |
|---|---|---|
| EP | 0753596 | 1/1997 |
| JP | 56-134096 | 10/1981 |
| JP | 9-314379 | 12/1997 |
| JP | 10-306347 | 11/1998 |
| JP | 10-306348 | 11/1998 |

OTHER PUBLICATIONS

Patent Abstracts of Japan, vol. 1999, No. 02, Feb. 26, 1999 & JP 10 306347 A (Nippon Steel Corp), Nov. 17, 1998.

Patent Abstracts of Japan, vol. 1999, No. 02, Feb. 26, 1999 & JP 10 306348 A (Nippon Steel Corp.), Nov. 17, 1998.

Patent Abstracts of Japan, vol. 006, No. 014 (M–108), Jan. 27, 1982 & JP 56 134096 A (Japan Steel Works, Ltd.), Oct. 20, 1981.

Patent Abstracts of Japan, vol. 1998, No. 04, Mar. 31, 1998 & JP 09 314379 A (Nippon Steel Corp), Dec. 9, 1997.

Patent Abstracts of Japan, vol. 1999, No. 01, Jan. 29, 1999 (1999½–01–29) & JP 10 286620 A (Sumitomo Metal Ind. Ltd.), Oct. 27, 1998.

* cited by examiner

*Primary Examiner*—James Hook
(74) *Attorney, Agent, or Firm*—Kenyon & Kenyon

(57) ABSTRACT

To provide a super-high strength line pipe that is excellent in low temperature toughness, can be field welded easily, and has a tensile strength of at least 900 MPa (exceeding ×100 of the API standard), and a production method thereof. The present invention relates to a super-high strength line pipe produced by shaping a steel plate into a pipe shape and arc welding seam portions, the strength of a base steel portion is 900 to 1,100 MPa and the strength of the weld metal is higher than the base steel strength −100 MPa. In the steel pipe, the Ni content of the weld metal is higher by at least 1% than that of the base steel. The combination of the chemical components of the steel plate with those of the weld metal, for accomplishing these steel pipes by a U&O step is shown concretely. A production method of the steel plate and the welding method for achieving the steel pipe are also described. Furthermore, a method of reducing the strength of the inner surface of the weld metal to restrict cracking at the time of pipe expansion is also shown.

4 Claims, 1 Drawing Sheet

SUPER-HIGH-STRENGTH LINE PIPE EXCELLENT IN LOW TEMPERATURE TOUGHNESS AND PRODUCTION METHOD THEREOF

BACKGROUND OF THE INVENTION

1. Field of the Invention

This invention relates to a super-high-strength line pipe excellent in low temperature toughness and having a tensile strength (TS) of at least 900 MPa. This line pipe can be employed widely as a line pipe for transporting a natural gas and a crude oil.

2. Description of the Related Art

The importance of pipelines has been increasing, in recent years, as a long-distance transportation method for crude oil and natural gas. At present, trunk line pipes for long-distance transportation have been designed on the basis of API (American Petroleum Institute) Standard ×65, and the pipelines designed in this way are overwhelmingly dominant in practice. However, high-strength line pipes have been desired in order (1) to improve transportation efficiency by higher pressurization and (2) to improve on-site working efficiency by the reduction of the outer diameter and weight of line pipes. Line pipes up to ×80 (a tensile strength of at least 620 MPa) have been put into practical application to this date, but the need for line pipes having a higher strength has become apparent. Research into production methods of super-high-strength line pipes have been made on the basis of the production technologies of the conventional ×80 line pipes (e.g. NKK Technical Report, No. 138(1992), pp.24–31 and The $7^{th}$ Offshore Mechanics and Arctic Engineering (1988), Volume V, pp.179–185), but these studies are believed to be capable of producing at most ×100 (tensile strength of at least 760 MPa) line pipes. Research into the production of steel plates for super-high-strength line pipes exceeding ×100 have been made already (PCT/JP96/00155, 00157). However, the conventional seam welding technology cannot be applied to such super-high-strength line pipes and, even though the steel plates can be produced, the steel pipes cannot be produced unless the problems encountered in combining the seam weld portions with the steel plate are solved. Super-high-strengthening of the pipe lines involves a large number of problems to be solved, such as the balance between the strength and the low temperature toughness, the toughness of the weld heat affected zone (HAZ), field weldability, softening of the joint, and so forth, and early development of a revolutionary super-high-strength line pipe (exceeding ×100) solving all these problems has been desired.

SUMMARY OF THE INVENTION

The present invention provides a super-high-strength line pipe that is excellent in the balance of low temperature toughness, insures easy field welding and has a tensile strength of at least 900 MPa (exceeding ×100 of the API Standard), and a production method thereof.

The inventors of the present invention have conductive intensive studies in search of the conditions that must be satisfied, by a steel material and a seam weld portion, to provide a super-high-strength steel pipe having a tensile strength of at least 900 MPa and excellent in both low temperature toughness and field weldability, and have invented a novel super-high-strength line pipe and a production method thereof.

The gist of the present invention lies in the following points.

(1) A super-high-strength line pipe excellent in low temperature toughness and characterized in that a tensile strength of the steel pipe at a base metal steel plate portion in a circumferential direction is from 900 to 1,000 MPa, and a mean tensile strength of a weld metal used for welding the seam portions is at least the tensile strength of the steel plate −100 MPa.

(2) A super-high-strength line pipe excellent in low temperature toughness according to the item (1), wherein the Ni content of the weld metal is higher by at least 1% than the Ni content of the steel plate.

(3) A super-high-strength line pipe excellent in low temperature toughness according to the item (1) or (2), wherein the steel plate is shaped into a pipe shape at a U&O step, and is expanded into a pipe after the seam portions are welded from the inner and outer surfaces thereof by submerged arc welding.

(4) A super-high-strength line pipe excellent in low temperature toughness according to any of the items (1) through (3), wherein the steel plate contains, as component thereof:

C: 0.04 to 0.10%.,

Si: not greater than 0.6%,

Mn: 1.7 to 2.5%,

P: not greater than 0.015%,

S: not greater than 0.003%,

Ni: 0.1 to 1.0%,

Mo: 0.15 to 0.60%,

Nb: 0.01 to 0.10%,

Ti: 0.005 to 0.030%, and

Al: not greater than 0.06%, contains selectively at least one of the following elements:

B: not greater than 0.0020%,

N: 0.001 to not greater than 0.006%,

V: not greater than 0.10%,

Cu: not greater than 1.0%,

Cr: not greater than 0.8%,

Ca: not greater than 0.01%,

REM: not greater than 0.02%, and

Mg: not greater than 0.006%, and the balance of iron and unavoidable impurities; and wherein the weld metal contains:

C: 0.04 to 0.14%,

Si: 0.05 to 0.40%,

Mn: 1.2 to 2.2%,

P: not greater than 0.010%,

S: not greater than 0.010%,

Ni: 1.3 to 3.2%,.

Cr+Mo+V: 1.0 to 2.5%,

B: not greater than 0.005%, and the balance of iron and unavoidable impurities; and wherein the Ni content of the weld metal is higher by at least 1% than the Ni content of the steel sheet.

(5) A method of producing a super-high strength line pipe excellent in low temperature toughness, comprising the steps of:

shaping a steel plate having a tensile strength of 900 to 1,100 MPa into a pipe shape at a U&O step;

welding seam portions from inner and outer surfaces thereof by submerged arc welding using a welding wire containing Fe as a principal component, 0.01 to 0.12% of C, not greater than 0.3% of Si, 1.2 to 2.4% of Mn, 4.0 to 8.5% of Ni and 3.0 to 5.0% of Cr+Mo+V, and a sintered flux or a fused flux; and expanding the steel plate into a pipe.

(6) A method of producing a super-high-strength line pipe excellent in low temperature toughness, comprising the steps of:

shaping into a pipe shape at a U&O step a steel plate having a tensile strength of 900 to 1,100 MPa and containing, as components thereof:

C: 0.04 to 0.10%,
Si: not greater than 0.6%,
Mn: 1.7 to 2.5%,
P: not greater than 0.015%,
S: not greater than 0.003%,
Ni: 0.1 to 1.0%,
Mo: 0.15 to 0.60%,
Nb: 0.01 to 0.10%,
Ti: 0.005 to 0.030%, and
Al: not greater than 0.06%, containing selectively at least one of the following elements:

B: not greater than 0.0020%,
N: 0.001 to not greater than 0.006%,
V: not greater than 0.10%,
Cu: not greater than 1.0%,
Cr: not greater than 0.8%,
Ca: not greater than 0.01%,
REM: not greater than 0.02%, and
Mg: not greater than 0.006%, and the balance of Fe and unavoidable impurities;

welding seam portions of the steel plate from inner and outer surfaces thereof by submerged arc welding using a welding wire containing Fe as a principal component, 0.01 to 0.12% of C, not greater than 0.3% of Si, 1.2 to 2.4% of Mn, 4.0 to 8.5% of Ni and 3.0 to 5.0% of Cr+Mo+V, and a sintered flux or a fused flux; and expanding the steel plate into a pipe.

(7) A method of producing a super-high-strength line pipe excellent in low temperature toughness according to the items (5) and (6), wherein the tensile strength of the weld metal of inner surface welding before pipe expansion is from 200 MPa below to the same as the tensile strength of the steel plate.

DESCRIPTION OF THE PREFERRED EMBODIMENT

Figure 3:
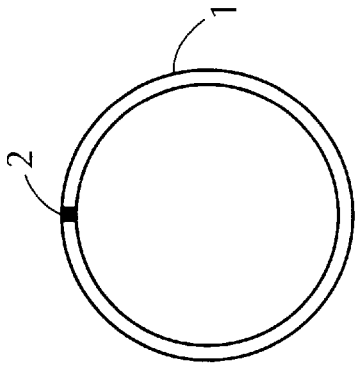
FIG. 3 schematically illustrates a side elevation view of the O-shape steel plate having a weld.

Hereinafter, the content of the present invention will be explained in detail.

The present invention is an invention relating to a super-strength-line pipe having a tensile strength (TS) of at least 900 MPa and excellent in low temperature toughness. Since the super-high strength line pipe of this strength level can withstand a pressure about twice that of ×65 that has been dominant in the past, twice as much gas can be transported by a pipe having the same size. In the case of ×65, the pipe thickness must be increased in order to elevate the pressure and consequently, the material cost, the transportation cost and the site welding cost become higher, with the result that the laying cost increases drastically. This is one of the reasons why a super-high strength line pipe having a tensile strength (TS) of at least 900 MPa and excellent in low temperature toughness is required. On the other hand, as the strength becomes higher, the production of steel pipes abruptly becomes more difficult. Therefore, the upper limit strength is set to 1,100 MPa in consideration of difficulty in industrial control. In order to obtain the properties of target strength, inclusive of the strength of a seam weld portion, the seam weld metal must have sufficiently high strength. As one of the standards, it has been believed essentially necessary that the pipe does not break from the weld metal in a tensile test with reinforcement of the weld in a circumferential direction inclusive of the seam weld portion. Low temperature toughness of the weld metal, that is used as-solidified, drops with the increase of the strength and from this aspect, the welding strength is preferably low. As a result of intensive experiments, the present inventors have realized that breakage does not occur from the weld metal in the tensile test with reinforcement of weld if the tensile strength of the weld metal is at least −100 MPa of that of the steel plate. Therefore, the present invention limits the mean tensile strength of the weld metal to at least (tensile strength of base steel plate portion of steel pipe in circumferential direction) −100 MPa. The upper limit strength of the weld metal is preferably not higher than 1,200 MPa for securing low temperature toughness and for preventing low temperature weld cracks. Incidentally, the tensile strength remains unaltered between the steel plate as it is and the steel pipe after shaping of the steel plate.

Steel plates are hot rolled after casting. In the case of the super-high-strength steel according to the present invention, the steel plate is thereafter quenched or, in some cases, tempered. On the other hand, chemical components must be adjusted in order to obtain an intended strength in the weld metal which has an as-solidified texture and the cooling rate of which is not high, and to obtain low temperature toughness compatible with that of the steel plate. Nickel (Ni) makes it possible to improve hardenability and to obtain a high strength even at a low cooling rate. It also promotes the formation of retained austenite in martensite lath, and improves low temperature toughness. Desired strength and desired low temperature toughness can be obtained by increasing the Ni content of the weld metal by 1% by means of the steel plate components.

The super-high-strength steel pipe described above can be mass-produced efficiently in a UO pipe-making step which executes seam welding by submerged arc welding from the inner and outer surfaces.

Figure 2:
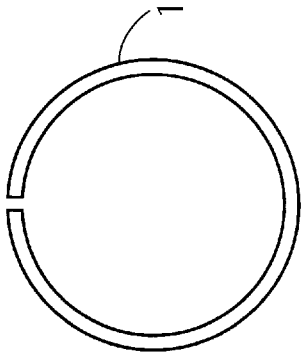
FIG. 2 schematically illustrates a side elevation view of a steel plate which has been deformed into an O-shape in an O-ring press in a UO pipe-making method.
Figure 1:
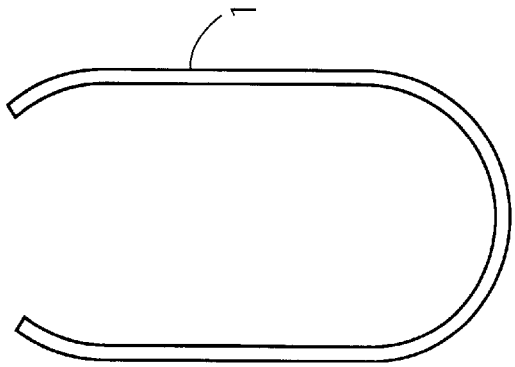
FIG. 1 schematically illustrates a side elevation view of a steel plate which has been deformed into a U-shape in a U-ing press in a UO pipe-making method.

With references to FIGS. 1–3, in a UO pipe-making method, a steel plate 1 is deformed into a U-shape by a U-ing press. Then, the U-shaped steel plate 1 is deformed into an O-shape by an O-ing press. The O-shaped steel plate 1 is then seam welded to form weld 2 to result in the UO pipe.

To accomplish super-high strength in a tensile strength of at least 900 MPa, it is necessary to restrict the formation of ferrite by transforming the steel to a microstructure consisting dominantly of a low temperature transformation microstructures, such as martensite and bainite.

Next, the reasons for restriction of the component elements will be described.

The C content is limited to 0.04 to 0.10%. Carbon is extremely effective for improving the strength of the steel, and at least 0.04% is necessary in order to obtain the target strength in the martensite structure. If the C content is too great, however, the low temperature toughness of the base steel as well as the HAZ and field weldability drop remarkably. Therefore, the upper limit is set to 0.10%. Preferably, the upper limit value is 0.08%.

Silicon (Si) is the element that is added so as to achieve deoxidation and to improve the strength. If its addition amount is too great, however, the HAZ toughness and field weldability drop remarkably. Therefore, the upper limit is set to 0.6%. Deoxidation of the steel can be achieved sufficiently by Al or Ti, too, and Si need not be always added.

Manganese (Mn) is an indispensable element for transforming the microstructure of the steel of the present invention to the structure consisting dominantly of martensite, and to secure the excellent balance of the strength and the low temperature toughness, and the lower limit of its content is 1.7%. However, if the Mn content is too great, hardenability of the steel increases to such a level that not only the HAZ toughness and field weldability are deteriorated, but center segregation of the continuous cast slab is promoted and the low temperature toughness of the base steel is deteriorated. Therefore, the upper limit is set to 2.5%.

The reason why Ni is added is to improve the low carbon steel of the present invention without deteriorating the low temperature toughness and field weldability. It has been found that in comparison with the addition of Cr and Mo, the addition of Ni hardly forms the hardened structure, which is detrimental to the low temperature toughness, in the rolled structure (particularly, in the center segregation band of the continuous cast slab), and the addition of a small amount of Ni of at least 0.1%, is effective for improving the HAZ toughness, too. (The amount of addition of Ni which is particularly effective for improving the HAZ toughness is at least 0.3%.) However, if the addition amount is too great, not only the economical factor but also the HAZ toughness and field weldability are deteriorated. Therefore, the upper limit is set to 1.0%. The addition of Ni is also effective for preventing Cu cracks during continuous casting and hot rolling. In this case, Ni must be added in an amount at least ⅓ of the Cu content.

The object of addition of Mo is to improve hardenability of the steel and to obtain a desired structure consisting dominantly of martensite. In the B-containing steel, the hardenability improving effect of Mo becomes higher, and when co-present with Nb, Mo supresses re-crystallization of austenite in controlled rolling and finely refines the austenite structure. To obtain such effects, at least 0.15% of Mo must be added. However, the addition of Mo in excess invites deterioration of the HAZ toughness and field weldability, and sometimes diminishes the hardenability improving effect of B. Therefore, the upper limit is set to 0.6%.

Boron (B), when added in a very small amount, drastically improves hardenability of the steel, and is an extremely effective element for obtaining the desired structure consisting dominantly of martensite. Furthermore, B enhances the hardenability improving effect of Mo, and when co-present with Nb, B synergistically improves hardenability. The addition of B in excess, however, not only invites deterioration of the low temperature toughness but also diminishes, in some cases, the hardenability impoving effect of B. Therefore, its upper limit is set to 0.0020%.

The steel according to the present invention contains, as the indispensable elements, 0.01 to 0.10% of Nb and 0.005 to 0.030% of Ti. When co-present with Mo, Nb not only supresses re-crystallization of austenite during controlled rolling and finely refines the structure, but also contributes to the improvements in precipitation hardening and hardenability, and increases the toughness of the steel. Particularly when Nb and B are co-present, the hardenability improving effect can be enhanced synergistically. If the Nb addition amount is too great, however, the HAZ toughness as well as field weldability are affected adversely. Therefore, the upper limit is set to 0.10%. On the other hand, the addition of Ti forms fine TiN, renders the microstructure fine by supressing coarsening of the austenite grains in re-heating of the slab and the austenite grains of the HAZ, and improves the low temperature toughness of the base steel and the HAZ. It also plays the role of fixing solid solution N, which is detrimental to the hardenability improving effect of B, as TiN. For this purpose, at least 3.4N (% by weight) of Ti is preferably added. When the Al amount is small (e.g. not greater than 0.005%), Ti forms oxides, functions as an intra-granular ferrite formation nucleus and finely refines the HAZ structure. To achieve such effects of TiN, at least 0.005% of Ti must be added. If the Ti content is too great, however, coarsening of TiN and precipitation hardening due to TiC develop, and the low temperature toughness gets deteriorated. Therefore, the upper limit is set to 0.030%.

Aluminum (Al) is the element that is ordinarily contained as the deoxidizer in the steel, and has the function of making the texture fine. If the Al content exceeds 0.06%, however, the amounts of Al type metallic inclusions increase and they spoil the cleanliness of the steel. Therefore, the upper limit is set to 0.06%. Because deoxidation can be achieved by Ti or Si, Al need not be always added.

Nitrogen (N) forms TiN, supresses coarsening of the austenite grains at the time of re-heating of the slab and the austenite grains of the HAZ and improves the low temperature toughness of both base steel and HAZ. The minimum necessary amount for this purpose is 0.001%. If the N content is too great, however, surface cracks on the slab, deterioration of the HAZ toughness by solid solution N and a drop in the hardenability improving effect of B will occur. Therefore, the upper limit must be restricted to 0.006%.

Furthermore, the P and S amounts as the impurity elements are limited to not greater than 0.015% and not greater than 0.003%, respectively, in the present invention. This is mainly to improve further the low temperature toughness of both base steel and HAZ. The reduction of the P content reduces center segregation of the continuous cast slab, prevents grain boundary cracking and improves the low temperature toughness. The reduction of the S content decreases MnS, that is elongated by hot rolling, and improves the ductility and toughness.

Next, the purpose of addition of V, Cu, Cr, Ca, REM and Mg will be explained.

The main object of adding these elements to the basic components is to improve further the strength and the toughness and to expand the size of the steel materials that can be produced, without spoiling the excellent features of the present invention. Therefore, the addition amount of these elements should be naturally limited.

Vanadium (V) has substantially the same effect as Nb, but its effect is lower than that of Nb. However, the effect of the addition of V is great in a super-high-strength steel, and the composite addition of Nb with V makes the excellent features of the present invention all the more remarkable. The upper limit of up to 0.10% is allowable from the aspect of the HAZ toughness and field weldability, and the particularly preferred range is from 0.03 to 0.08%.

Copper (Cu) increases the strength of the base steel and the weld portion, but if its content is too great, the HAZ toughness as well as field weldability is extremely deteriorated. Therefore, the upper limit of the Cu content is set to 1.0%.

Chromium (Cr) increases the strength of both base steel and weld portion, but if its content is to great, the HAZ toughness as well as field weldability is extremely deteriorated. Therefore, the upper limit of the Cr content is 0.6%.

Calcium (Ca) and REM control the form of sulfide (MnS) and improve the low temperature toughness (the increase in absorbed energy in the Charpy test, etc). When Ca and REM are added in amounts exceeding 0.006% and 0.02%, respectively, large amounts of CaO—CaS or REM—CaS are formed, and they result in large clusters and large inclusions, not only spoiling the cleanliness of the steel but exerting adverse influences on field weldability. Therefore, the upper limits are set to 0.006% for Ca and 0.02% for REM. Incidentally, in super-high strength line pipes, in particular, it is specifically effective to decrease the S and O contents to not greater than 0.001% and not greater than 0.002%, respectively, and to adjust their contents so as to satisfy the relation $0.5 \leqq ESSP \leqq 10.0$ where $ESSP=(Ca)[1-124(O)]/1.25S$.

Magnesium (Mg) forms oxides that are finely dispersed, restricts coarsening of the grains of the weld heat affected zone and improves the low temperature toughness. If it content exceeds 0.006%, coarse oxides are formed and the toughness is deteriorated, on the contrary.

Besides the limitation of the individual elements described above, the relation $1.9 \leqq P \leqq 4.0$ is preferably satisfied, where P is given by:

$$P=2.7C+0.4Si+Mn+0.8Cr+0.45(Ni+Cu)+(1+\beta)Mo-1+\beta$$

with the proviso that when $B \geqq 3$ ppm, $\beta=1$, and when $B<3$ ppm, $\beta=0$. This is directed to accomplish the intended balance between the strength and the low temperature toughness. The reason why the lower limit of the P value is set to 1.9 is to obtain a high strength of at least 900 MPa and an excellent low temperature toughness. The upper limit of the P value is set to 4.0 so as to retain excellent HAZ toughness and field weldability.

Even when the steel contains the chemical components described above, the desired properties cannot be obtained unless an appropriate production condition is employed which provides a structure consisting dominantly of fine martensite+bainite. The principal method of obtaining the texture consisting dominantly of fine martensite comprises the steps of hot-working re-crystallized grains in the range of a non-recrystallization temperature to form austenite grains that are flat in the direction of the sheet thickness, and cooling the steel plate at a cooling rate higher than a critical cooling rate at which the ferrite formation is restricted.

A desirable production method comprises the steps of re-heating a slab having the chemical components of the present invention at 950 to 1,250° C., rolling the slab at a temperature of the steel material higher than 700° C. so that the cumulative reduction ratio at 700 to 950° C. attains at least 50%, and cooling the steel plate down to 550° C. or below at a cooling rate of at least 10° C./sec. Tempering is carried out, whenever necessary, at a temperature lower than an $A_{C1}$ transformation point.

The steel plate so produced is then shaped into a pipe shape, and its seam portions are arc welded to form a steel pipe.

Next, the reasons for restriction of the weld metal will be explained.

The C content is limited to 0.04 to 0.14%. Carbon (C) is extremely effective for improving the strength of the steel, and at least 0.04% is necessary for obtaining the target strength in the martensite structure. However, if the C content is too great, low temperature weld cracking is more likely to occur, and the maximum hardness of the HAZ at a so-called "T cross" portion at which the site weld portion and the seam weld portion cross each other increases. Therefore, the upper limit is set to 0.14%, and is preferably 0.10%.

At least 0.05% of silicon (Si) is necessary for preventing blow-holes, but if the Si content is too great, the low temperature toughness is extremely deteriorated. Therefore, the upper limit is set to 0.6%. Particularly when double-face welding and multi-layer welding are carried out, the large Si content deteriorates the low temperature toughness of the re-heated portion.

Manganese (Mn) is the indispensable element for securing the balance between excellent strength and low temperature toughness, and its lower limit is 1.2%. If the Mn content is too great, however, segregation is promoted. In consequence, not only the low temperature toughness is deteriorated but also the production of the welding material becomes difficult. Therefore, the upper limit is set to 2.2%.

The object of the addition of Ni is to secure the strength by improving hardenability, and to further improve the low temperature toughness. If the Ni content is not greater than 1.3%, the desired strength and low temperature toughness cannot be obtained easily. If the Ni content is too great, on the other hand, hot cracking is very likely to occur. Therefore, the upper limit is set to 3.2%.

It is by no means easy to distinguish the differences of the effects of Cr, Mo and V, but these elements are all added in order to obtain a high strength by increasing hardenability. The effect is not sufficient if Cr+Mo+V is not greater than 1.2%, but the addition of these elements in excess increases the risk of low temperature cracking. Therefore, the upper limit is set to 2.5%.

The addition of a small amount of B improves hardenability and is effective for improving the low temperature toughness of the weld metal. If the B content is too great, however, the low temperature toughness drops, on the contrary. Therefore, the upper limit is set to 0.005%.

The weld metal sometimes contains elements such as Ti, Al, Zr, Nb, Mg, etc, that are added, whenever necessary, for insuring excellent refining and solidification at the time of welding, and the balance of the weld metal consists of iron and unavoidable impurities. Incidentally, the P and S contents are preferably small in order to prevent deterioration of the low temperature toughness and to reduce low temperature crack susceptibility.

The sizes of the line pipes, to which the present invention is directed, are generally a diameter of about 450 to about 1,500 mm, and a thickness of about 10 to about 40 mm. A method of efficiently producing the steel pipes having such sizes has already been established. This method comprises the steps of shaping a steel plate into a u shape and then O shape in a U&O step, provisionally welding the seam portions, executing submerged arc welding from inner and outer surfaces, thereafter expanding it into a pipe and correcting and improving the degree of circularity.

Submerged arc welding is a welding method that involves a high rate of dilution of a base metal, and in order to obtain desired properties, or in other words, a desired weld metal composition, it is essentially necessary to select the welding materials in consideration of dilution of the base metal. Hereinafter, the reasons for restriction of the chemical composition of the welding wire will be described, but the welding method can fundamentally produce the super-high strength line pipe stipulated in claim 4.

To obtain the range of the C content required for the weld metal, the C content is limited to 0.01 to 0.12% in consideration of dilution by the base metal components and the addition of C from the atmosphere.

To obtain the range of the Si content required for the weld metal, the Si content is limited to not greater than 0.3% in consideration of dilution by the base metal components.

To obtain the range of the Mn content required for the weld metal, the Mn content is limited to 1.2 to 2.4% in consideration of dilution by the base metal components.

To obtain the range of the Ni content required for the weld metal, the Ni content is limited to 4.0 to 8.5% in consideration of dilution by the base metal components.

To obtain the range of Cr+Mo+V content required for the weld metal, its range is limited to 3.0 to 5.0% in consideration of dilution by the base metal components.

The contents of other impurities such as P and S are preferably as small as possible, and B can be added so as to secure the strength. Furthermore, Ti, Al, Zr, Nb, Mg, etc, can be used for the purpose of deoxidation.

Welding can be carried out by using not only a single electrode but also multi-electrodes. When welding is made by using multi-electrodes, various wires may be used in combination, and the individual wires need not fall within the component range described above, but the mean composition calculated from the respective wire components and the consumption quantities must fall within the component range.

The flux used for submerged arc welding can be broadly classified into a sintered flux and a fused flux. The sintered flux has the advantages that an alloying material can be added and the amount of diffusible hydrogen is small, but involves the problems that it is likely to become powder and repetition of its use is difficult. On the other hand, the fused flux has the advantages that it is like glass powder, has high grain strength and is not easily hygroscopic, but involves the problem that the amount of diffusible hydrogen is considerably high. In the case of the super-high strength steel such as in the present invention, low temperature weld cracking is likely to occur and from this aspect, the sintered flux is desirable. On the other hand, the fused flux that can be recovered and used repeatedly is suitable for mass-production, and its cost is low. The problem is the high cost in the sintered flux and the necessity for strict quality control in the fused flux, but this problem exists within the range that can be tackled industrially, and both of them can be used in essence.

Although the welding condition has been substantially fully technically established, the preferred range is as follows. The dilution rate of the base metal changes with the welding condition, particularly with the welding heat input. Generally, the higher the heat input, the higher becomes the dilution rate of the base metal. However, the dilution rate of the base metal cannot be increased under the low welding speed condition even when the heat input is increased. In order to secure sufficient welding penetration in one-pass welding of double-faces, the welding speed must be set to a level higher than a certain level together with the increase of the welding heat input, and the welding speed of 1 to 3 m/minute is an appropriate range. Welding at a speed of less than 1 m/min is inefficient as seam welding of the line pipe, while high-speed welding at a rate exceeding 3 m/min cannot give a stable bead shape. The heat input is preferably within the range of 2.5 to 5.0 kJ/mm in the case of 18 mm thick plates. If the heat input is too small, sufficient welding penetration cannot be obtained. On the other hand, if too much heat input is applied, softening of the heat affected zone becomes great, and the toughness drops, too.

The degree of circularity is improved by pipe expansion after seam welding. To accomplish good circularity, it is necessary to let the steel plate undergo deformation up to a plastic region, and in the case of the super-high-strength steel, as in the present invention, the expansion ratio of at least about 0.7% (pipe expansion ratio=(circumference after pipe expansion−circumference before pipe expansion)/circumference before pipe expansion). When pipe expansion is carried out to a level exceeding 2%, deterioration of the toughness becomes great due to the plastic deformation of both base metal and weld portion. Therefore, the pipe expansion ratio is preferably from 0.7 to not greater than 2%.

If the shape of the super-high-strength steel pipe is not good after U&O shaping, the strain concentrates locally on the softened zone of the seam welding heat affected zone at the time of pipe expansion, thereby inviting drastic deterioration of the toughness and, in some cases, cracking. If the strength of the weld metal on the inner surface side, on which the strain is very likely to concentrate, is lowered, the stress concentration on the softened zone can be mitigated. Due to the plastic deformation by pipe expansion, the strength increases after pipe expansion due to work hardening, but if the strength of the weld metal is too low, a weld metal fracture is invited by the weld joint tension of the steel pipe after pipe expansion. Therefore, the lower limit of the weld metal on the inner surface side is limited to the range of the tensile strength of the steel plate −200 MPa.

EXAMPLE 1

Hereinafter, the present invention will be explained concretely. Steels having the chemical components tabulated in Table 1 were melted in a 300-ton converter to form continuous cast slabs. After being re-heated to 1,100° C., each slab was rolled in a re-crystallization range and then subjected to controlled rolling to achieve a cumulative reduction ratio of 80% at 900 to 750° C. till the thickness attained 18 mm. The resulting steel plate was cooled with water so that the water cooling stop temperature reached 400 to 500° C. The strength of the steels A, B and C, that had the chemical components falling within the range of the present invention, was within the target range, and had a high low temperature toughness (absorbed energy at −40° C. in the Charpy test). On the other hand, the steel E, which had a high C content and to which Ni was not added, exhibited a strength falling within the target range, but its low temperature toughness was low. The steel plates produced in this way were shaped into a pipe shape in a U&O plant. After being welded provisionally, each steel plate was subjected to one-pass submerged arc welding for each of the inner and outer surfaces under the welding condition of three electrodes, 1.5 m/min and 3.5 kJ/mm, using the welding wires shown in Table 2. Pipe expansion was thereafter carried out to a pipe expansion ratio of 1%. As shown in Table 2, Examples 1 to 6 of the present invention provided satisfactory weld beads, the chemical components of the weld metal were within the range of the scope of claims, and the strength was appropriate. The steel plates of Comparative Example Nos. 7 and 8 were within the range of the present invention but the wire components were outside the range of the present invention. Therefore, the strength was low in No. 7 and low temperature cracking occurred in No. 8. For these reasons, the tensile test was not carried out on these Examples. In No. 9, the welding wire was within the range of the present invention but the steel plate was outside the present range. The evaluation result of the steel pipe properties were tabulated in Table 3. The base metal portions within the range of the present invention all had excellent mechanical properties. When the seam weld portions were within the range of the present invention, excellent properties could be obtained, but weld metal fracture and low temperature weld cracking occurred in the joint tensile test in Comparative Example 7, and the toughness of the weld metal was low in Comparative Example No. 8. Therefore, these two steel pipes failed to satisfy the required properties of the line pipe.

TABLE 1

| | Steel | C | Si | Mn | P | S | Ni | Mo | Nb | Ti | Al |
|---|---|---|---|---|---|---|---|---|---|---|---|
| Example of this Invention | A | 0.06 | 0.09 | 1.95 | 0.012 | 0.001 | 0.36 | 0.35 | 0.03 | 0.01 | 0.02 |
| | B | 0.07 | 0.25 | 1.84 | 0.007 | 0.001 | 0.60 | 0.47 | 0.03 | 0.02 | 0 |
| | C | 0.04 | 0.11 | 1.78 | 0.005 | 0.001 | 0.85 | 0.45 | 0.04 | 0.01 | 0.03 |
| | D | 0.05 | 0.28 | 2.03 | 0.008 | 0.002 | 0.37 | 0.52 | 0.03 | 0.02 | 0.02 |
| Comparative Example | E | 0.12 | 0.47 | 2.15 | 0.011 | 0.001 | | 0.14 | 0.04 | 0.02 | 0.03 |

| | Steel | N | B | V | Cu | Cr | Others | TS (MPa) | $vE_{-40}$ (J) |
|---|---|---|---|---|---|---|---|---|---|
| Example of this Invention | A | 0.0027 | 0.0012 | | | 0.28 | | 986 | 275 |
| | B | 0.004 | | | 0.64 | | Ca: 0.004 | 1012 | 242 |
| | C | 0.002 | 0.0009 | 0.06 | | | | 970 | 283 |
| | D | 0.004 | | 0.05 | 0.40 | 0.65 | Mg: 0.0008 | 1058 | 290 |
| Comparative Example | E | 0.0030 | 0.0013 | | | | | 921 | 121 |

TABLE 2

| | | welding method | | | | | | | welding result | | | | | | | |
|---|---|---|---|---|---|---|---|---|---|---|---|---|---|---|---|---|
| | | | wire component (mass %) | | | | | | | weld metal component (Mass %) | | | | | | | |
| Section | Example No. | steel No. | C | Si | Mn | Ni | Cr + Mo + v | flux | result | C | Si | Mn | P | S | Ni | B | Cr + Mo + v |
| Example of this invention | 1 | A | 0.038 | 0.22 | 1.73 | 4.9 | 4.3 | fused type | fair | 0.06 | 0.26 | 1.68 | 0.008 | 0.002 | 2.4 | 0.0009 | 1.9 |
| | 2 | B | 0.01 | 0.02 | 1.85 | 5.7 | 3.9 | fused type | fair | 0.07 | 0.14 | 1.82 | 0.006 | 0.003 | 2.8 | 0.0003 | 1.8 |
| | 3 | C | 0.1 | 0.31 | 2.20 | 5.4 | 3.5 | fused type | fair | 0.06 | 0.12 | 1.97 | 0.008 | 0.004 | 2.9 | 0.0020 | 1.7 |
| | 4 | D | 0.07 | 0.17 | 1.66 | 6.5 | 4.1 | sintered type | fair | 0.07 | 0.09 | 1.85 | 0.008 | 0.003 | 2.1 | 0.0003 | 2.4 |
| | 5 | A | 0.01 | 0.02 | 1.85 | 5.7 | 3.9 | sintered type | fair | 0.08 | 0.19 | 1.91 | 0.007 | 0.003 | 2.2 | 0.0011 | 2.1 |
| | 6 | B | 0.07 | 0.17 | 1.66 | 6.5 | 4.1 | fused type | fair | 0.07 | 0.24 | 1.76 | 0.007 | 0.002 | 3.1 | 0.0005 | 2.1 |
| Comp. Example | 7 | A | 0.08 | 0.11 | 1.75 | 2.1 | 3.7 | fused type | fair | 0.07 | 0.28 | 1.86 | 0.008 | 0.003 | 1.2 | 0.0014 | 1.8 |
| | 8 | A | 0.23 | 0.31 | 1.76 | 7.2 | 4.0 | fused type | low temp. crack fair | 0.15 | 0.30 | 1.84 | 0.009 | 0.002 | 3.2 | 0.0017 | 1.9 |
| | 9 | E | 0.07 | 0.17 | 1.66 | 6.5 | 4.1 | fused type | fair | 0.07 | 0.35 | 1.88 | 0.008 | 0.004 | 2.8 | 0.0012 | 1.6 |

| | | welding result | | | | |
|---|---|---|---|---|---|---|
| Section | Example No. | steel No. | Nb | Al | Ti | weld metal strength (MPa) |
| Example of this Invention | 1 | A | 0.03 | 0.013 | 0.017 | 964 |
| | 2 | B | 0.03 | 0.017 | 0.009 | 1020 |
| | 3 | C | 0.04 | 0.018 | 0.010 | 1012 |
| | 4 | D | 0.02 | 0.017 | 0.011 Zr: 0.012 | 998 |
| | 5 | A | 0.03 | 0.022 | 0.013 | 1080 |
| | 6 | B | 0.03 | 0.012 | 0.007 Mb: 0.0015 | 1057 |

TABLE 2-continued

| | | | | | | |
|---|---|---|---|---|---|---|
| Comp. | 7 | A | 0.03 | 0.015 | 0.014 | 806 |
| Example | 8 | A | 0.04 | 0.019 | 0.012 | |
| | 9 | E | 0.02 | 0.014 | 0.013 | 1023 |

TABLE 3

| | | Properties steel pipe base metal | | | | |
|---|---|---|---|---|---|---|
| Section | Example No | C direction YS MPa | C direction TS MPa | $vE_{-40}$ J | Joint tension | Weld metal properties $vE_{-40}$ J |
| Example of this Invention | 1 | 899 | 988 | 268 | fair | 184 |
| | 2 | 940 | 1011 | 250 | fair | 154 |
| | 3 | 876 | 973 | 272 | fair | 180 |
| | 4 | 985 | 1060 | 281 | fair | 163 |
| | 5 | 901 | 990 | 270 | fair | 147 |
| | 6 | 933 | 1015 | 245 | fair | 171 |
| Comp. Example | 7 | 888 | 986 | 265 | weld metal fracture | 67 |
| | 8 | 903 | 990 | 269 | not made | 38 |
| | 9 | 814 | 925 | 97 | fair | 166 |

As described above, the present invention can provide a super-high strength line pipe excellent in low temperature toughness, can reduce the laying cost of a long-distance pipeline, and can contribute to the solution the worldwide energy problem.

What is claimed is:

1. A super-high-strength line pipe excellent in low temperature toughness characterized in that:

a tensile strength of said steel pipe at a base metal steel plate portion in a circumferential direction is from 900 to 1,100 MPa;

a submerged arc seam weld portion comprising a weld metal disposed between abutting ends of said steel plate portion shaped into a pipe shape at a U&O step;

a mean tensile strength of said weld metal of said submerged arc seam weld portion being at least the tensile strength of said steel plate minus 100 MPa;

said pipe having an expanded diameter of about 450 to about 1,500 mm and a wall thickness of about 10 to about 40 mm, said pipe having been expanded after forming said submerged arc seam weld portion by submerged arc welding;

wherein said steel plate contains, as components thereof:

C: 0.04 to 0.10%,
Si: not greater than 0.6%,
Mn: 1.7 to 2.5%,
P: not greater than 0.015%,
S: not greater than 0.003%,
Ni: 0.1 to 1.0%,
Mo: 0.15 to 0.60%,
Nb: 0.01 to 0.10%,
Ti: 0.005 to 0.030%, and
Al: not greater than 0.06%, and containing selectively at least one of the following elements:

B: not greater than 0.0020%,
N: 0.001 to not greater than 0.006%,
V: not greater than 0.10%,
Cu: not greater than 1.0%,
Cr: not greater than 0.8%,
Ca: not greater than 0.01%,
REM: not greater than 0.02%, and
Mg: not greater than 0.006%, and the balance of iron and unavoidable impurities; and wherein said weld metal contains:

C: 0.04 to 0.14%,
Si: 0.05 to 0.40%,
Mn: 1.2 to 2.2%,
P: not greater than 0.010%;
S: not greater than 0.010%,
Ni: 1.3 to 3.2%,
Cr+Mo+V: 1.0 to 2.5%,
B: not greater than 0.005%, and the balance of iron and unavoidable impurities; and wherein the Ni content of said weld metal is higher by at least 1% than the Ni content of said steel plate.

2. A method of producing a super-high-strength line pipe excellent in low temperature toughness, comprising the steps of:

shaping into a pipe shape at a U&O step a steel plate having a tensile strength of 900 to 1,100 MPa and containing, as components thereof:

C: 0.04 to 0.10%,
Si: not greater than 0.6%,
Mn: 1.7 to 2.5%,
P: not greater than 0.015%,
S: not greater than 0.003%,
Ni: 0.1 to 1.0%,
Mo: 0.15 to 0.60%,
Nb: 0.01 to 0.10%,
Ti: 0.005 to 0.030%, and
Al: not greater than 0.06%, and containing selectively at least one of the following elements:

B: not greater than 0.0020%,
N: 0.001 to not greater than 0.006%,
V: not greater than 0.10%, Cu: not greater than 1.0%,
Cr: not greater than 0.8%,
Ca: not greater than 0.01%,
REM: not greater than 0.02%, and
Mg: not greater than 0.006%, and the balance of iron and unavoidable impurities;

welding seam portions of said steel plate from inner and outer surfaces by submerged arc welding using a welding wire containing Fe as a principal component, 0.01 to 0.12% of C, not greater than 0.3% of Si, 1.2 to 2.4% of Mn, 4.0 to 8.5% of Ni and 3.0 to 5.0% of Cr+Mo+V, and a sintered flux or a fused flux; and after said submerged arc welding, expanding said pipe shape steel plate into a pipe, said pipe having a diameter of about 450 to about 1,500 mm and a wall thickness of about 10 to about 40 mm.

3. A method of producing a super-high-strength line pipe excellent in low temperature roughness according to claim 2, wherein the tensile strength of the weld metal of inner surface welding before pipe expansion is from 200 Mpa below to the same as the tensile strength of said steel plate.

4. A method of producing a super-high-strength line pipe excellent in low temperature toughness, comprising the steps of:

shaping into a pipe shape at a U&O step a steel plate having a tensile strength of 900 to 1,100 MPa and containing, as components thereof:
C: 0.04 to 0.10%,
Si: not greater than 0.6%,
Mn: 1.7 to 2.5%,
P: not greater than 0.015%,
S: not greater than 0.003%,
Ni: 0.1 to 1.0%,
Mo: 0.15 to 0.60%,
Nb: 0.01 to 0.10%,
Ti: 0.005 to 0.030%, and
Al: not greater than 0.06%, and containing selectively at least one of the following elements:
B: not greater than 0.0020%,
N: 0.001 to not greater than 0.006%,
V: not greater than 0.10%,
Cu: not greater than 1.0%,
Cr: not greater than 0.8%,
Ca: not greater than 0.01%,
REM: not greater than 0.02%, and
Mg: not greater than 0.006%, and the balance of iron and unavoidable impurities;

welding seam portions of said steel plate from inner and outer surfaces by submerged arc welding using a welding wire containing Fe as a principal component, 0.01 to 0.12% of C, not greater than 0.3% of Si, 1.2 to 2.4% of Mn, 4.0 to 8.5% of Ni and 3.0 to 5.0% of Cr+Mo+V, and a sintered flux or a fused flux;

thereby providing a weld metal containing:
C: 0.04 to 0.14%,
Si: 0.05 to 0.40%,
Mn: 1.2 to 2.2%,
P: not greater than 0.010%,
S: not greater than 0.010%,
Ni: 1.3 to 3.2%,
Cr+Mo+V: 1.0 to 2.5%,
B: not greater than 0.005%, and the balance of iron and unavoidable impurities; and wherein the Ni content of said weld metal is higher by at least 1% than the Ni content of said steel plate, and after said submerged arc welding, expanding said pipe shape steel plate into a pipe, said pipe having a diameter of about 450 to about 1,500 mm and a wall thickness of about 10 to about 40 mm.

* * * * *